US011318503B2

(12) United States Patent
Haremaki

(10) Patent No.: US 11,318,503 B2
(45) Date of Patent: May 3, 2022

(54) CLEANING METHOD

(71) Applicant: SUGINO MACHINE LIMITED, Uozu (JP)

(72) Inventor: Hiroki Haremaki, Uozu (JP)

(73) Assignee: SUGINO MACHINE LIMITED, Uozu (JP)

( * ) Notice: Subject to any disclaimer, the term of this patent is extended or adjusted under 35 U.S.C. 154(b) by 0 days.

(21) Appl. No.: 17/170,337

(22) Filed: Feb. 8, 2021

(65) Prior Publication Data

US 2021/0331213 A1 Oct. 28, 2021

(30) Foreign Application Priority Data

Apr. 24, 2020 (JP) ..... JP2020-077361

(51) Int. Cl.
*B08B 3/02* (2006.01)
*B08B 5/02* (2006.01)

(52) U.S. Cl.
CPC ..... *B08B 3/022* (2013.01); *B08B 3/024* (2013.01); *B08B 5/023* (2013.01)

(58) Field of Classification Search
CPC ..... B08B 3/022; B08B 3/024; B08B 5/023
See application file for complete search history.

(56) References Cited

U.S. PATENT DOCUMENTS 6,106,635 A * 8/2000 Hamada ..... B08B 1/007 134/144
2006/0185696 A1* 8/2006 Yamamoto ..... B08B 3/02 134/33
2017/0323809 A1* 11/2017 Fukaya ..... H01L 21/67051
2018/0272376 A1* 9/2018 Abe ..... B05C 11/1039

FOREIGN PATENT DOCUMENTS

DE 102007026237 A1 12/2008
EP 1080797 A2 * 3/2001 ..... B08B 3/08
EP 1640077 A2 3/2006
EP 1997568 A1 12/2008
JP H8-085063 A 4/1996
JP H9-260321 A 10/1997
JP 2011-062577 A 3/2011
JP 2016-055275 A 4/2016
JP 2017-062657 A 3/2017
JP 2020-037178 A 3/2020

OTHER PUBLICATIONS

Extended European Search Report dated Aug. 6, 2021 in a corresponding European Patent Application No. 21158906.4 (7 pages).
Office Action dated Jul. 13, 2021 in a corresponding Japanese Patent Application No. 2020-077361.

* cited by examiner

*Primary Examiner* — Sharidan Carrillo
(74) *Attorney, Agent, or Firm* — United IP Counselors, LLC

(57) ABSTRACT

A cleaning method of sufficiently cleaning a workpiece is provided. The cleaning method, including: rotating or swinging a workpiece having a first cleaning surface about a table rotation axis; ejecting cleaning fluid from a nozzle along an ejection axis; and swinging the nozzle about a nozzle rotation axis parallel to the table rotation axis to keep a constant impact angle formed between the ejection axis and the first cleaning surface for cleaning the workpiece.

18 Claims, 11 Drawing Sheets

CLEANING METHOD

CROSS-REFERENCE TO RELATED APPLICATIONS

This application claims the benefit of priority to Japanese Patent Application No. 2020-077361 filed on Apr. 24, 2020, the contents of which are hereby incorporated by reference.

BACKGROUND

A method of cleaning a workpiece by rotating a table to which the workpiece is fixed and ejecting a cleaning fluid onto the workpiece from a nozzle installed on a side of the table has been used (for example, Japanese Patent Laid-Open No. 2016-055275).

BRIEF SUMMARY

The jet of the cleaning fluid does not impinge to every corner of the workpiece depending on the shape of the workpiece, which results in insufficient cleaning.

An object of the present invention is to provide a cleaning method of sufficiently cleaning the workpiece.

An aspect of the present invention provides a cleaning method, including:

rotating or swinging a workpiece having a first cleaning surface about a table rotation axis;

ejecting cleaning fluid from a nozzle along an ejection axis; and swinging the nozzle about a nozzle rotation axis parallel to the table rotation axis to keep a constant impact angle formed between the ejection axis and the first cleaning surface for cleaning the workpiece.

The cleaning fluid is, for example, compressed air, dry air or a cleaning liquid. When the cleaning fluid is a cleaning fluid, the nozzle may eject the cleaning fluid to spread out onto a plane. The dry air is supplied, for example, from a blower. The cleaning fluid may be heated.

The workpiece is fixed to a rotating or swinging table.

With respect to the phase of the table, the nozzle may be simple harmonic oscillation. Then, if the cleaning surface is a plane, the trajectory drawn by the intersection of the cleaning surface and the ejection axis becomes a sine wave.

The cleaning liquid preferably ejected in a straight shape or fan shape. When the cleaning liquid is ejected in a fan shape, the jet, spreads in the direction the nozzle rotation axis. More preferably, the cleaning liquid spreads on a plane inclined from the ejection plane by 3 to 45 degrees.

The cleaning fluid may be ejected in the direction in which the table rotation axis extends. The cleaning fluid is ejected downward from above the table, for example.

The impact angle is preferably between 60 degrees and 90 degrees, more preferably between 80 degrees and 90 degrees.

According to the cleaning method of the present invention, the workpiece is sufficiently cleaned.

DETAILED DESCRIPTION

First Embodiment

Figure 1:
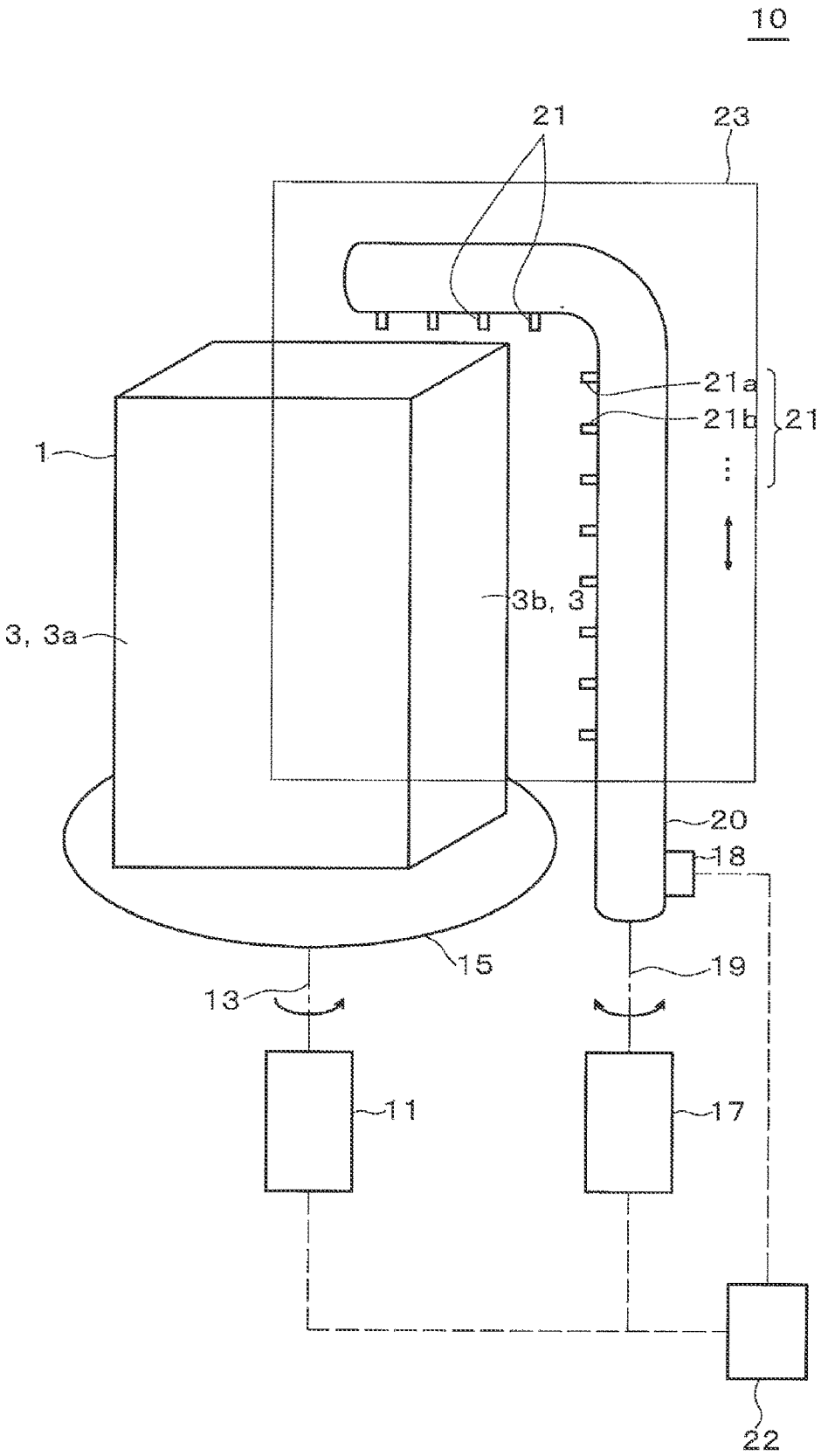
FIG. 1 shows a cleaning apparatus used in a cleaning method according to a first embodiment.

As shown in FIG. 1, the cleaning apparatus 10 according to a first embodiment includes a motor (table rotation motor) 11, a table 15, a motor (nozzle rotation motor) 17, a nozzle retracting device 18, a nozzle pipe 20, a plurality of nozzles 21, and a control device 22.

The motor 11 is connected to the table 15. The motor 11 may include a reduction gear (not shown). A workpiece 1 is fixed to the table 15. For example, the table 15 rotates at a constant angular velocity about a vertical table rotation axis 13.

The motor 17 is connected to the nozzle pipe 20. The motor 17 may include a reduction gear (not shown). Preferably, the motor 17 is a synchronous motor.

The nozzle pipe 20 is L-shaped so as to surround the area where the workpiece 1 is rotated. The nozzle pipe 20 is bent along an ejection plane 23. The nozzle pipe 20 may be U-shaped by further bending the lower part of the nozzle pipe 20. The nozzle pipe 20 may be straight. The nozzle pipe 20 is swung about a nozzle rotation axis 19. The nozzle rotation axis 19 is parallel to the table rotation axis 13. The nozzle retracting device 18 advances and retracts the nozzle pipe 20 along the nozzle rotation axis 19.

The nozzles 21 are fixed side by side inside the nozzle pipe 20. For the vertical portion of the nozzle pipe 20, the first nozzle from above is referred to as the nozzle 21*a*, and the second nozzle is referred to as the nozzle 21*b*. The nozzle 21 ejects cleaning liquid along an ejection axis 25. The ejection axis 25 is on the ejection plane 23. The ejection plane 23 passes through the nozzle rotation axis 19. In the nozzles 21 disposed on the lateral side of the workpiece 1, the ejection axis 25 is perpendicular to the nozzle rotation axis 19. That is, the ejection axis 25 extends horizontally. In the nozzles 21 disposed above the workpiece 1, the ejection axis 25 is parallel to the nozzle rotation axis 19. That is, the ejection axis 25 extends vertically.

The nozzle 21 is a fan-shaped ejection nozzle. The nozzle 21 is swung integrally with the nozzle pipe 20. The motor 11, the motor 17, and the nozzle retracting device 18 are controlled by the control device 22.

The table rotation axis 13 according to the present embodiment is vertical, but is not limited thereto. For example, the table rotation axis 13 may be installed horizontally or inclined.

The workpiece 1 is, for example, a box-shaped workpiece. The workpiece 1 has a cleaning surface 3 and a boundary 5. A plurality of cleaning surfaces 3 (e.g., cleaning surfaces 3*a*, 3*b*) is disposed in a circumferential direction of the table rotation axis 13. The cleaning surface 3 is a cutting surface, a raw surface of the cast surface or the rolled material. The boundary 5 is an intersection of the cleaning surface 3*a* and the cleaning surface 3*b*. The boundary 5 may be a sharp edge, or a raw surface of the cast surface or the rolled material.

Figure 2:
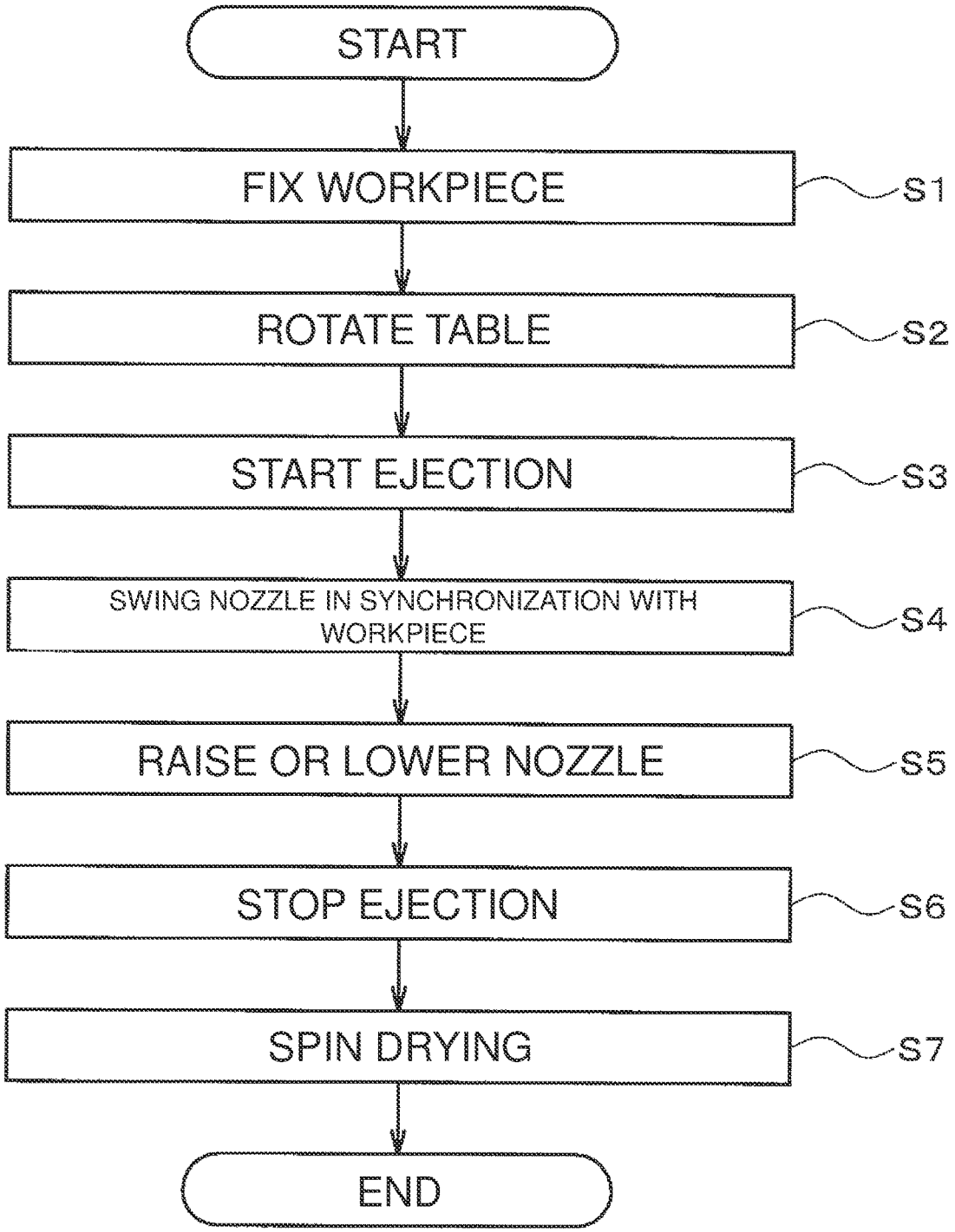
FIG. 2 is a flowchart showing the cleaning method according to the first embodiment.

As shown in FIG. 2, in the cleaning method according to the first embodiment, the workpiece 1 is fixed to the table 15 in step S1. The table 15 is rotated in step S2. The nozzle 21 ejects the cleaning liquid in step S3. The nozzle 21 is swung in synchronization with the workpiece 1 in step S4. The nozzle is raised or lowered in step S5. The ejection is stopped in step S6. The spin drying is performed in step S7. Steps S2, S3, and S4 may be started at the same time, or the order may be changed. Steps S5 and S7 may be omitted.

The jet pressure of the cleaning liquid is, for example, 1.5 MPa to 20 MPa. Preferably, the jet pressure is from 3 MPa to 15 MPa. The jet flow rate of the cleaning liquid per nozzle is, for example, 0.02 L/s to 1 L/s. The cleaning ability improves as the jet pressure and the jet flow rate increase. On the other hand, the apparatus becomes large with the increase of the jet pressure and the jet flow rate, and the power consumption tends to increase. The jet pressure and the jet flow rate are determined within a reasonable range.

Figure 3A:
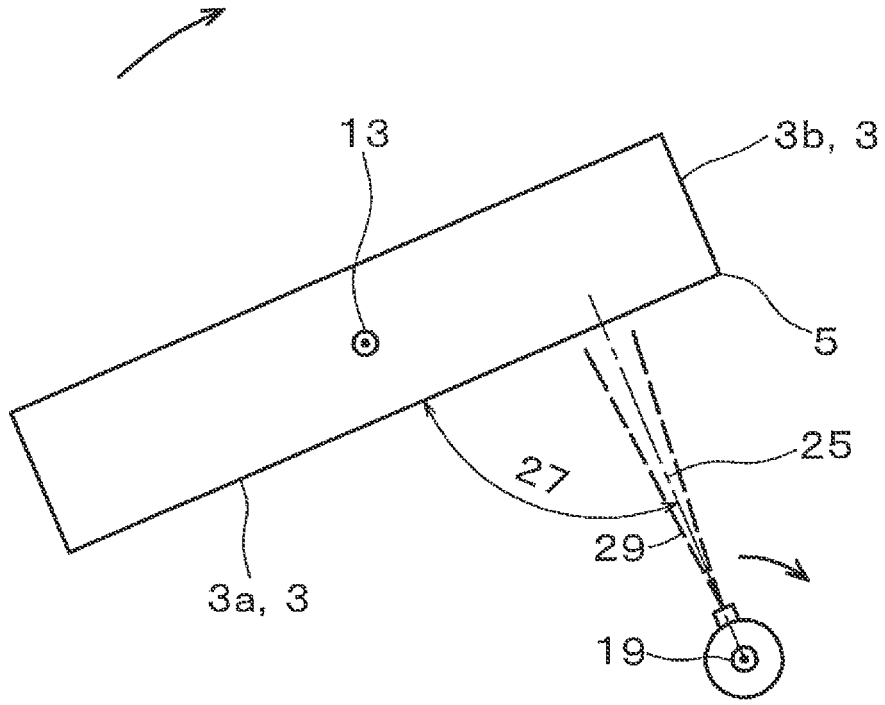
FIG. 3A is a plan view showing the cleaning method according to the first embodiment.

The steps S4 will be described in detail with reference to FIGS. 3A to 3C. As shown in FIG. 3A, the nozzle 21 ejects the jet 29 along the ejection axis 25. When viewed from the ejection plane 23 toward the ejection axis 25, the jet 29 spreads on a plane inclined by an angle 37 (see FIG. 4). The ejection axis 25 rotates in synchronization with the rotation of the workpiece 1 so as to intersect at a predetermined impact angle 27 with the cleaning surface 3*a*. The ejection plane 23 also intersects the cleaning surface 3*a* at an impact angle 27.

Figure 3B:
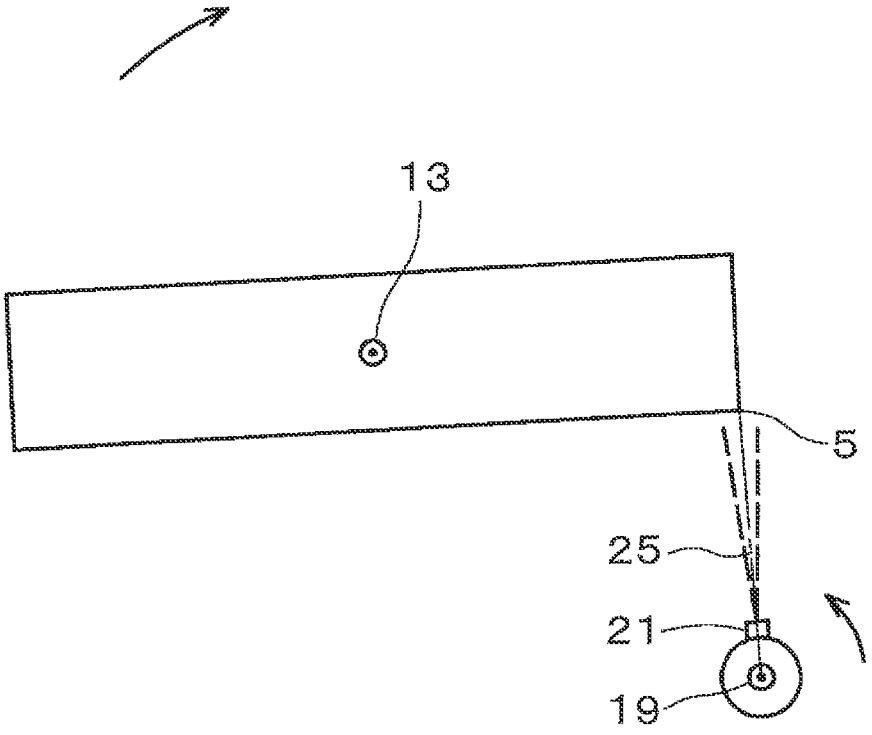
FIG. 3B is a plan view showing the cleaning method according to the first embodiment.

As shown in FIG. 3B, when the ejection axis 25 reaches the boundary 5, the nozzle 21 continues to rotate in synchronization with the rotation of the workpiece 1 as the ejection axis 25 continues to collide with the boundary 5.

Figure 3C:
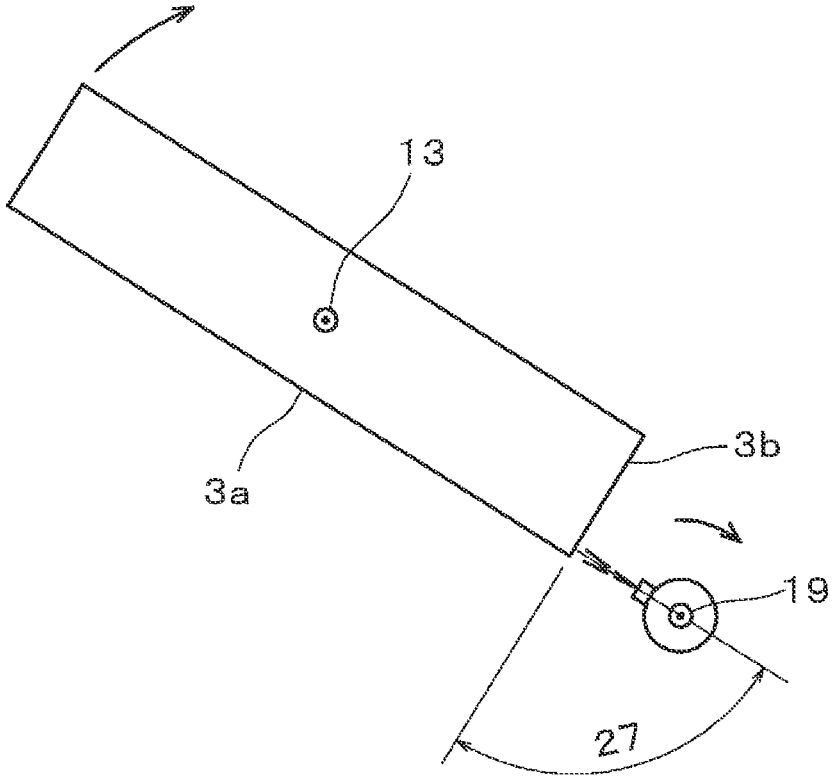
FIG. 3C is a plan view showing the cleaning method according to the first embodiment.

As shown in FIG. 3C, when the angle formed by the ejection axis 25 and the next cleaning surface 3*b* reaches the impact angle 27, cleaning starts for the cleaning surface 3*b*. That is, the nozzle 21 is rotated so that the ejection axis 25 is away from the boundary 5 to keep the impact angle 27 between the ejection axis 25 and the cleaning surface 3*b*. The ejection plane and the cleaning surface 3*b* also keeps the impact angle 27.

Figure 4:
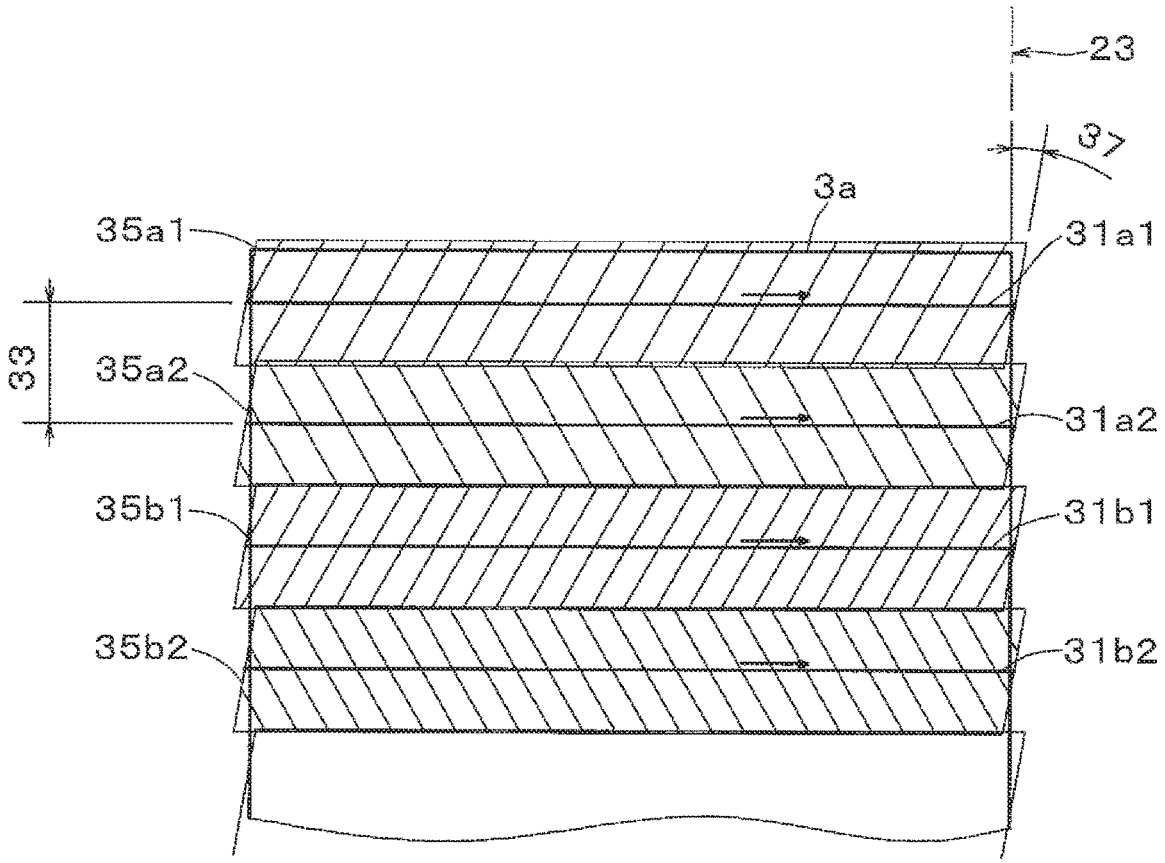
FIG. 4 shows a trajectory of an intersection of a cleaning axis line and a cleaning surface, and an impingement range of a jet according to the first embodiment.

In step S5, as shown in FIG. 4, the nozzle is lowered by a constant distance 33 every time the table 15 rotates once. FIG. 4 shows trajectories 31*a*1, 31*a*2, 31*b*1, 31*b*2, and ranges 35*a*1, 35*a*2, 35*b*1, 35*b*2 to which the jet 29 impinges when cleaning the entire surface of the cleaning surface 3*a* by rotating the table two times. The nozzle may be raised every time the table 15 rotates once. The lowering and raising of the nozzle may be combined.

The trajectory 31*a*1 shows the intersection of the cleaning surface 3*a* and the ejection axis 25 of the nozzle 21*a* in the first rotation. The trajectory 31*a*2 shows the intersection of the cleaning surface 3*a* and the ejection axis 25 of the nozzle 21*a* in the second rotation. The trajectory 31*b*1 shows the intersection of the cleaning surface 3*a* and the ejection axis 25 of the nozzle 21*b* in the first rotation. The trajectory 31*b*2 shows the intersection of the cleaning surface 3*a* and the ejection axis 25 of the nozzle 21*b* in the second rotation. The trajectories 31*a*1, 31*a*2, 31*b*1, and 31*b*2 are straight lines extending horizontally.

The range 35*a*1 shows the impact range of the nozzle 21*a* in the first rotation. The range 35*a*2 shows the impact range of the nozzle 21*a* in the second rotation. The range 35*b*1 shows the impact range of the nozzle 21*b* in the first rotation. The range 35*b*2 shows the impact angle of the nozzle 21*b* in the second rotation. The impact range 35*a*1 protrudes above the upper end of the cleaning surface 3*a*. The impact ranges 35*a*1, 35*a*2, 35*b*1, 35*b*2 each overlaps adjacent impact range. As the spreading direction of the jet 29 is inclined when viewed from the direction of the ejection axis 25, the adjacent jets 29 do not collide with each other.

In FIG. 4, the entire surface of the workpiece 1 is cleaned by two rotations. The entire surface of the workpiece 1 may be cleaned by single rotation with increased installation number of the nozzle 21, or by widening the ejection angle of the nozzle 21. In other words, the range where the jets generated by the adjacent nozzles 21 collide with the cleaning surface 3*a* may overlap. In this case, step S5 may be omitted.

Second Embodiment

Figure 5:
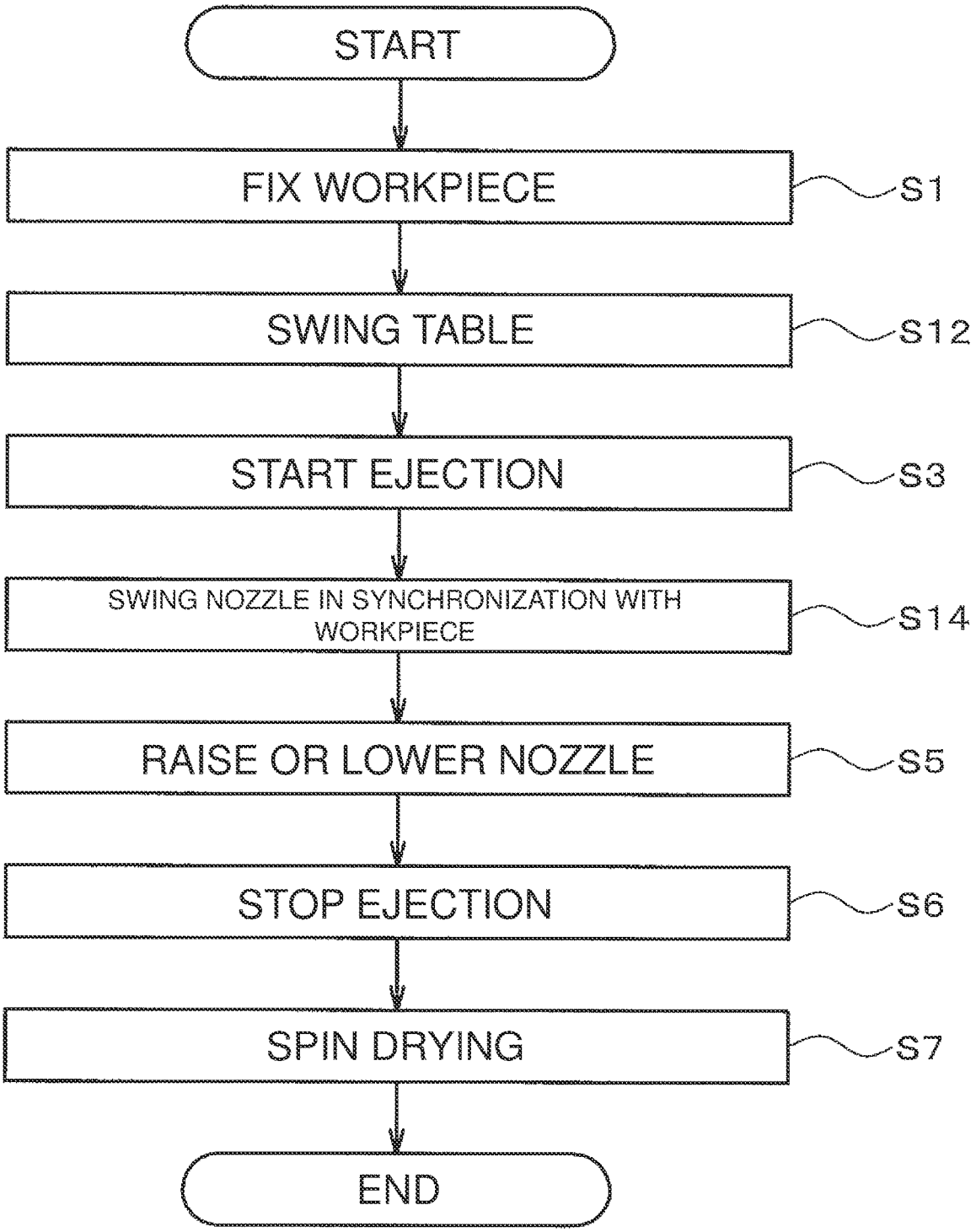
FIG. 5 is a flowchart showing a cleaning method according to the second embodiment.

The cleaning apparatus 10 according to the first embodiment is also used in the second embodiment. However, the workpiece 1 has a single cleaning surface 3*a*. As shown in FIG. 5, in the present embodiment, the table 15 swings in step S12. The table 15 has a constant swing width. Preferably, the table 15 swings at a constant rate in most of the middle of the swing range, except for acceleration d reduction.

The step S14 will be described in detail with reference to FIGS. 6A to 6C. The cleaning method of the cleaning surface 3*a* in FIG. 6A is substantially to the same as the first embodiment.

Figure 6A:
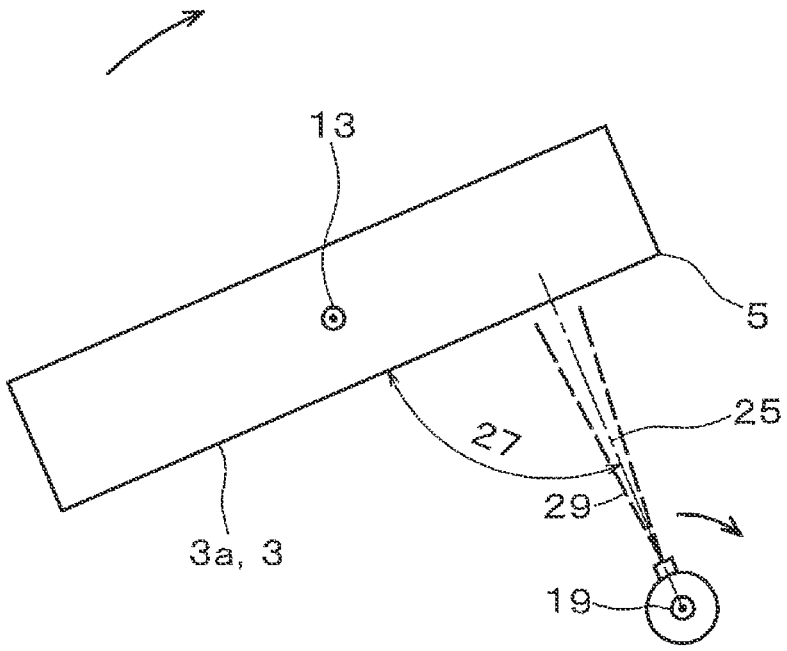
FIG. 6A is a plan view showing the cleaning method according to the second embodiment.
Figure 6B:
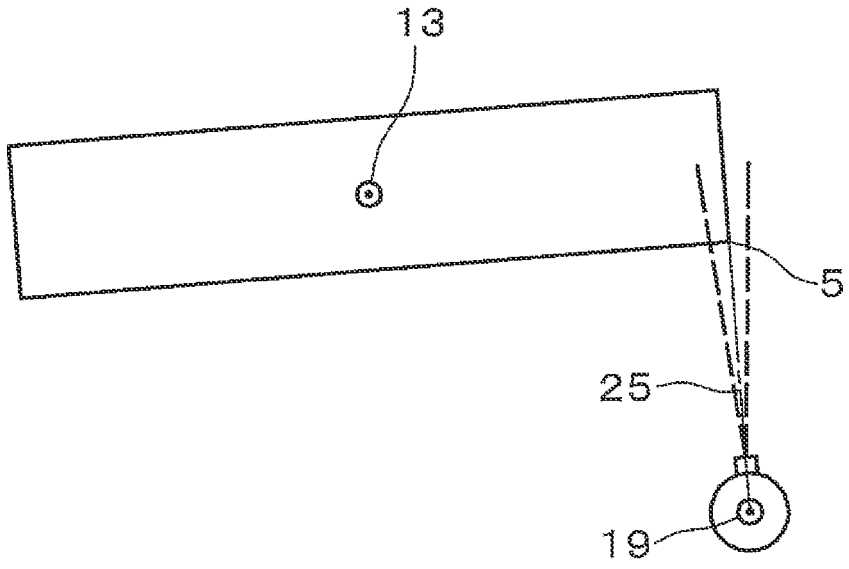
FIG. 6B is a plan view showing the cleaning method according to the second embodiment.

As shown in FIG. 6B, when the ejection axis 25 reaches the boundary 5, the table 15 is reversely rotated. At the same time, the nozzle 21 is also reversely rotated.

Figure 6C:
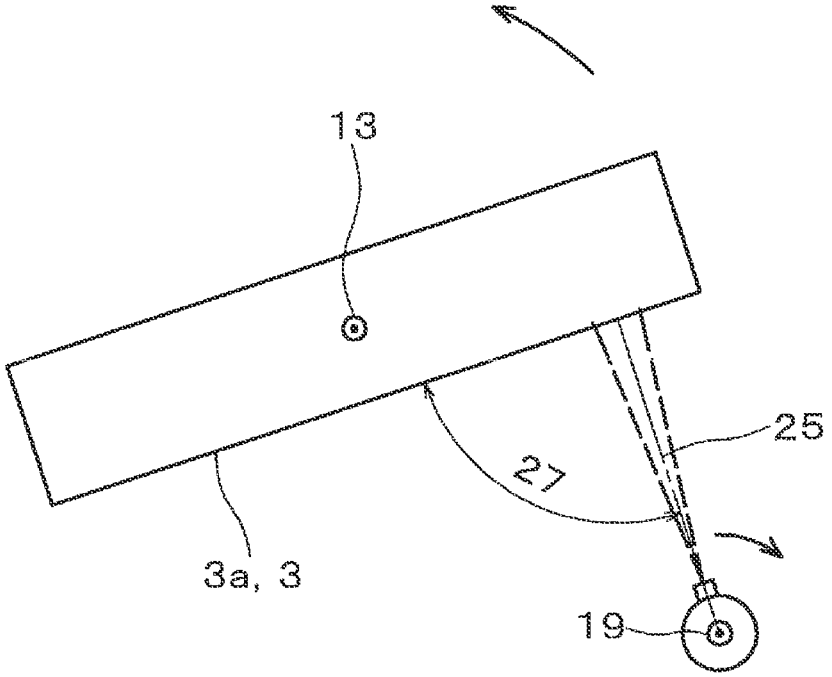
FIG. 6C is a plan view showing the cleaning method according to the second embodiment.
Figure 7:
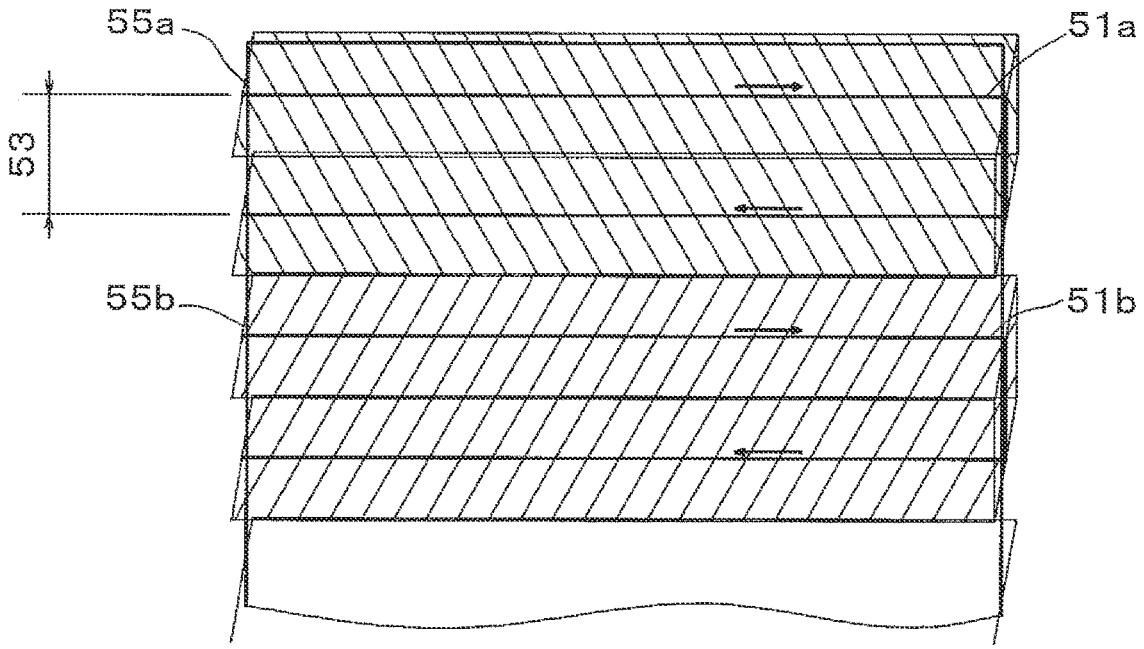
FIG. 7 shows a trajectory of an intersection of a cleaning axis line and a cleaning surface, and an impingement range of a jet according to the second embodiment.

As shown in FIG. 6C, the nozzle 21 is rotated so that the impact angle 27 formed between the ejection axis 25 and the cleaning surface 3*a* again remains a predetermined angle.

The impact angle 27 in a counter-clockwise rotation as in FIG. 6C may be changed from the impact angle 27 in a clockwise rotation as in FIG. 6A. For example, the impact angle 27 in FIG. 6A may be 70 degrees, while the impact angle 27 in FIG. 6C may be 110 degrees.

Note that, in the above-described embodiment, a cleaning liquid is used as a cleaning fluid, but compressed air or dry air may be used as a cleaning fluid. The compressed air or dry air is ejected on the ejection plane 23 or along the ejection plane 23. If the cleaning fluid is compressed air, the nozzle 21 is a straight type nozzle (e.g., a pipe nozzle). The nozzle 21 may eject compressed air or dry air in a linear shape or plane shape. The nozzle 21 may be close to each other to eject a plurality of air jets in a bundle. If the cleaning fluid is dry air, a slit nozzle 21 is available.

The present invention is not limited to the embodiments described above, and various modifications be made without departing from the gist of the present invention, and all technical matters included in the technical idea described in the claims are the subject matter of the present invention. While the foregoing embodiments illustrate preferred examples, those skilled in the art will appreciate that various alternatives, modifications, variations, or improvements may be made in light of the teachings disclosed herein and are within the scope of the appended claims.

REFERENCE SIGNS LIST

1 Workpiece
3, 3*a*, 3*b* Cleaning surface
13 Table rotation axis
15 Table
21 Nozzle
27 Ejection angle

What is claimed is:

1. A cleaning method, comprising:

rotating a workpiece about a table rotation axis, the workpiece having a first cleaning surface, a second cleaning surface, and a boundary where the first cleaning surface and the second cleaning surface intersect each other;

ejecting cleaning fluid from a nozzle along an ejection axis;

rotating the nozzle about a nozzle rotation axis fixed to a position parallel to the table rotation axis to keep an impact angle constant, the impact angle formed between the ejection axis and the first cleaning surface for cleaning the first cleaning surface;

rotating the nozzle about the nozzle rotation axis when the ejection axis reaches the boundary, so that the ejection axis intersects the boundary until an angle formed by the second cleaning surface and the ejection axis becomes the impact angle; and rotating the nozzle about the nozzle rotation axis so that an angle formed between the ejection axis and the second cleaning surface is kept constant at the impact angle for cleaning the second cleaning surface.

2. The cleaning method according to claim 1, further comprising:

ejecting the cleaning fluid from the nozzle along the ejection axis arranged on an ejection plane passing the nozzle rotation axis.

3. The cleaning method according to claim 1, further comprising:

raising or lowering the nozzle by a constant distance for each single rotation of the workpiece.

4. The cleaning method according to claim 1, further comprising:

rotating the workpiece about the table rotation axis at a constant angular velocity.

5. The cleaning method according to claim 1, further comprising:

ejecting the cleaning fluid from a plurality of the nozzles.

6. The cleaning method according to claim 2, further comprising:

synchronizing a rotation of the nozzle with a rotation of the workpiece so that an angle formed between the ejection plane and the first cleaning surface is kept constant at the impact angle.

7. The cleaning method according to claim 2, further comprising:

rotating the nozzle when the ejection axis reaches the boundary, so that the ejection axis intersects the boundary until an angle formed by the second cleaning surface and the ejection axis becomes the impact angle.

8. The cleaning method according to claim 2, further comprising:

reversely rotating the workpiece when the ejection axis reaches an end of the first cleaning surface.

9. The cleaning method according to claim 2, further comprising:

rotating the workpiece about the table rotation axis at a constant angular velocity.

10. The cleaning method according to claim 2, further comprising:

ejecting the cleaning fluid from a plurality of the nozzles.

11. The cleaning method according to claim 3, further comprising:

rotating the workpiece about the table rotation axis at a constant angular velocity.

12. The cleaning method according to claim 6, further comprising:

rotating the nozzle when the ejection axis reaches the boundary, so that the ejection axis intersects the boundary until an angle formed by the second cleaning surface and the ejection axis becomes the impact angle.

13. The cleaning method according to claim 6, further comprising:

reversely rotating the workpiece when the ejection axis reaches an end of the first cleaning surface.

14. The cleaning method according to claim 6, further comprising:

rotating the workpiece about the table rotation axis at a constant angular velocity.

15. A cleaning method comprising:

rotating a workpiece having a first cleaning surface about a table rotation axis;

ejecting cleaning fluid from a nozzle along an ejection axis;

rotating the nozzle about a nozzle rotation axis parallel to the table rotation axis to keep an impact angle constant, the impact angle formed between the ejection axis and the first cleaning surface for cleaning the workpiece; and reversely rotating the workpiece when the ejection axis reaches an end of the first cleaning surface.

16. The cleaning method according to claim 15, further comprising:

raising or lowering the nozzle by a constant distance when the ejection axis reaches an end of the first cleaning surface.

17. The cleaning method according to claim 15, further comprising:

rotating the workpiece about the table rotation axis at a constant angular velocity.

18. The cleaning method according to claim 16, further comprising:

rotating the workpiece about the table rotation axis at a constant angular velocity.

* * * * *